US005562070A

United States Patent [19]

Schechter et al.

[11] Patent Number: 5,562,070

[45] Date of Patent: Oct. 8, 1996

[54] ELECTROHYDRAULIC CAMLESS VALVETRAIN WITH ROTARY HYDRAULIC ACTUATOR

[75] Inventors: Michael M. Schechter, Farmington Hills; Michael B. Levin, Bloomfield, both of Mich.

[73] Assignee: Ford Motor Company, Dearborn, Mich.

[21] Appl. No.: 498,771

[22] Filed: Jul. 5, 1995

[51] Int. Cl.[6] ..... F01L 9/02

[52] U.S. Cl. ..... 123/90.12; 123/90.13

[58] Field of Search ..... 123/90.11, 90.12, 123/90.13, 90.15

[56] References Cited

U.S. PATENT DOCUMENTS

| | | | |
|---|---|---|---|
| 3,455,209 | 2/1967 | Preston et al. | 91/417 R |
| 3,738,337 | 6/1973 | Massie | 123/90.12 |
| 4,446,825 | 5/1984 | Giardini et al. | 123/90.65 |
| 5,058,857 | 10/1991 | Hudson | 123/90.12 |
| 5,193,494 | 3/1993 | Sono et al. | 123/90.12 |
| 5,209,453 | 5/1993 | Aota et al. | 123/90.12 |
| 5,255,641 | 10/1993 | Schechter | 123/90.12 |
| 5,275,136 | 1/1994 | Schechter et al. | 123/90.12 |
| 5,367,990 | 11/1994 | Schechter | 123/90.12 |
| 5,373,817 | 12/1994 | Schechter et al. | 123/90.12 |
| 5,375,419 | 12/1994 | Wright et al. | 123/90.12 |
| 5,404,844 | 4/1995 | Schechter | 123/90.12 |
| 5,410,994 | 5/1995 | Schechter | 123/90.12 |
| 5,419,301 | 5/1995 | Schechter | 123/673 |
| 5,456,221 | 10/1995 | Schechter | 123/90.12 |
| 5,456,222 | 10/1995 | Schechter | 123/90.12 |
| 5,456,223 | 10/1995 | Miller et al. | 123/90.12 |

*Primary Examiner*—Weilun Lo
*Attorney, Agent, or Firm*—Donald A. Wilkinson

[57] ABSTRACT

An engine valve assembly (10) within an electrohydraulic camless valvetrain cooperates with a hydraulic system (8) having a low pressure branch (70) and a high pressure branch (68) to selectively open and close engine valve (12). Engine valve (12) is affixed to a valve piston (16) within a piston chamber (18). A volume (42) below piston (16) is connected to high pressure branch (68) and a volume (20) above piston (16) is selectively connected to the high pressure branch (68) or the low pressure branch (70) via a rotary valve (34), to effect engine valve opening and closing. A motor (60) effects the rotation of the rotary valve (34). The rotary valve (34) includes an internal hollow (92) operatively and selectively connected to windows (86 and 90) in a valve sleeve (66) to allow high pressure and low pressure fluid flow through the valve (34).

11 Claims, 3 Drawing Sheets

ELECTROHYDRAULIC CAMLESS VALVETRAIN WITH ROTARY HYDRAULIC ACTUATOR

FIELD OF THE INVENTION

The present invention relates to a system to control intake and exhaust valves in an electrohydraulic camless valvetrain of an internal combustion engine.

This application is related to co-pending application Ser. No. 08/417,364 filed Apr. 5, 1995; and U.S. Pat. Nos. 5,456,222; 5,456,221; 5,456,223; and 5,497,736.

BACKGROUND OF THE INVENTION

The increased use and reliance on microprocessor control systems for automotive vehicles and increased confidence in hydraulic as opposed to mechanical systems is making substantial progress in engine systems design possible. One such electrohydraulic system is a control for engine intake and exhaust valves. The enhancement of engine performance to be attained by being able to vary the timing, duration, lift and other parameters of the intake and exhaust valves' motion in an engine is known in the art. This allows one to account for various engine operating conditions through independent control of the engine valves in order to optimize engine performance. All this permits considerably greater flexibility in engine valve control than is possible with conventional cam-driven valvetrains.

One such system is disclosed in U.S. Pat. No. 5,255,641 to Schechter (assigned to the assignee of this invention). A system disclosed therein employs a pair of solenoid valves per engine valve, one connected to a high pressure source of fluid and one connected to a low pressure source of fluid. They are used to control engine valve opening and closing. While this arrangement works adequately, the number of solenoid valves required per engine can be large. This is particularly true for multi-valve type engines that may have four or five valves per cylinder and six or eight cylinders. A desire arises, then, to reduce the number of valves needed in order to reduce the cost and complexity of the system. If each pair of solenoid vanes is replaced by a single actuator, then the number of valves is cut in half.

This same patent also discloses using rotary distributors to reduce the number of solenoid valves required per engine, but then employs an additional component rotating in relationship to the crankshaft to properly time the rotary distributors. This tie-in to the crankshaft may reduce some of the benefit of a camless valvetrain and, thus, may not be ideal. Further, the system still employs a separate solenoid valve for high pressure and low pressure sources of hydraulic fluid. A desire, then, exists to further reduce the number of valves controlling the high and low pressure sources of fluid from the hydraulic system.

One possible mechanism to accomplish this is to incorporate a rotary hydraulic actuator into the hydraulic system. One such system is disclosed in patent application Ser. No. 08/369,433, filed Jan. 6, 1995, (assigned to the assignee of this invention). The system disclosed in that patent application employs a rotary valve using external slots for routing the hydraulic fluid. A further desire exists to make any hydraulic actuator used as efficient as possible to reduce the power consumed by valve activation and the overall size of the system.

SUMMARY OF THE INVENTION

In its embodiments, the present invention contemplates a hydraulically operated valve control system for an internal combustion engine. The system includes a high pressure hydraulic branch and a low pressure hydraulic branch, having a high pressure source of fluid and a low pressure source of fluid, respectively. A cylinder head member is adapted to be affixed to the engine and includes an enclosed bore and chamber. An engine valve is shiftable between a first and a second position within the cylinder head bore and chamber, and a hydraulic actuator has a valve piston coupled to the engine valve and reciprocable within the enclosed chamber which thereby forms a first cavity which varies in displacement as the engine valve moves. A rotary valve assembly is mounted to the cylinder head member and includes a sleeve and a cylindrical valve body mounted within the sleeve. The valve body includes at least one high pressure window, at least one low pressure window and at least one central window, with the sleeve including at least one high pressure window, at least one low pressure window and at least one central window with the three windows operatively engaging the corresponding windows in the valve body. The cylinder head member includes three ports, a first port operatively engaging the high pressure branch and the sleeve high pressure window, a second port operatively engaging the low pressure branch and the sleeve low pressure window, and a third port operatively engaging the first cavity and the sleeve central window, with the three ports being oriented such that the valve body can be rotated so that the high pressure window in the valve body aligns with the high pressure window in the sleeve, neither the high nor low pressure window in the valve body aligns with one of the windows in the sleeve, and the low pressure window in the valve body aligns with the low pressure window in the sleeve; sequentially. The valve control system also includes means for biasing the engine valve toward its closed position, and actuator means for rotating the rotary valve relative to the sleeve.

Accordingly, an object of the present invention is to provide an electrohydraulic camless valvetrain as disclosed in U.S. Pat. No. 5,255,641 to Schechter that provides an improvement in a camless variable valve control system by incorporating a rotary valve to control the high and low pressure hydraulic fluid supplied to and drawn from a hydraulic engine valve wherein the rotary valve employs an internal hollow in the rotary valve to effect fluid transfer, thus maximizing fluid carrying capacity for a given size rotary valve.

An advantage to the present invention is the reduced cost and complexity of the above noted system by eliminating the need for two solenoid valves per engine valve (or hydraulically coupled valves) and employing at most one rotary valve to control at least one engine valve in a hydraulic system that incorporates a high pressure and a low pressure branch selectively connected to cavities above pistons mounted on respective engine valves with a large flow of hydraulic fluid through a minimized rotary valve diameter; this will reduce the rotary valve size and weight, thus reducing the required torque and electric energy consumption.

DETAILED DESCRIPTION OF THE PREFERRED EMBODIMENTS

Figure 1:
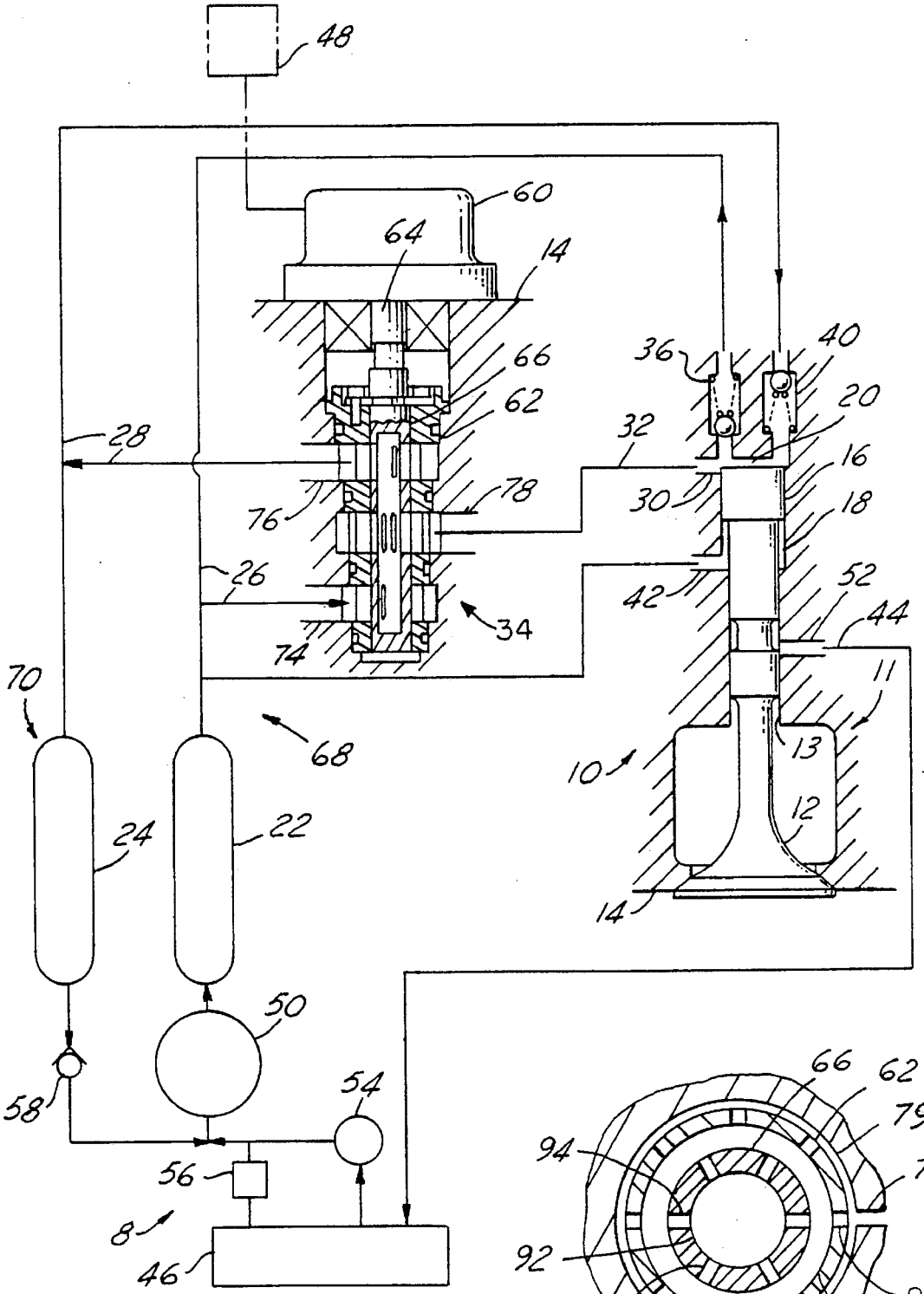
FIG. 1 is a schematic diagram showing a single engine valve, from an engine valvetrain, and an electrohydraulic system for selectively supplying hydraulic fluid to the engine valve.
Figure 5:
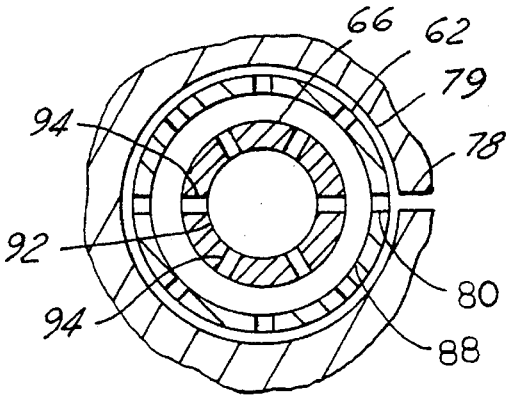
FIG. 5 is a sectional view, on a reduced scale, taken along line 5—5 in FIG. 2.

FIG. 1 shows a hydraulic system 8, for controlling a valvetrain in an internal combustion engine, connected to a single electrohydraulic engine valve assembly 10 of the electrohydraulic valvetrain. An electrohydraulic valvetrain is disclosed in U.S. Pat. No. 5,255,641 to Schechter, (assigned to the assignee of this invention), which is incorporated herein by reference.

An engine valve 12, for inlet air or exhaust gas as the case may be, is located within a sleeve 13 in a cylinder head 14, which is a component of engine 11. A valve piston 16, fixed to the top of the engine valve 12, is slidable within the limits of a piston chamber 18.

Hydraulic fluid is selectively supplied to a volume 20 above the piston 16 through an upper port 30, which is connected to a rotary valve 34, via a hydraulic line 32. The volume 20 is also selectively connected to a high pressure fluid reservoir 22 through a high pressure check valve 36 via high pressure lines 26, or to a low pressure fluid reservoir 24 via low pressure lines 28 through a low pressure check valve 40. A volume 42 below the piston 16 is always connected to the high pressure reservoir 22 via the high pressure lines 26. The pressure surface area above the piston 16, in volume 20, is larger than the pressure area below it, in volume 42.

In order to effectuate the engine valve opening and closing, a predetermined high pressure must be maintained in the high pressure lines 26, and a predetermined low pressure, relative to the high pressure, must be maintained in the low pressure lines 28. The preferred hydraulic fluid is oil, although other fluids can be used rather than oil.

The high pressure lines 26 connect to the high pressure fluid reservoir 22 to form a high pressure branch 68 of the hydraulic system 8. A high pressure pump 50 supplies pressurized fluid to the high pressure branch 68 and charges the high pressure reservoir 22. The pump 50 is preferably of the variable displacement variety that automatically adjusts its output to maintain the required pressure in the high pressure reservoir 22 regardless of variations in consumption, and may be electrically driven or engine driven.

The low pressure lines 28 connect to the low pressure fluid reservoir 24, to form a low pressure branch 70 of the hydraulic system 8. A check valve 58 connects to the low pressure reservoir 24 and is located to assure that the pump 54 is not subjected to pressure fluctuations that occur in the low pressure reservoir 24 during engine valve opening and closing. The check valve 58 does not allow fluid to flow into the low pressure reservoir 24, and it only allows fluid to flow in the opposite direction when a predetermined amount of fluid pressure has been reached in the low pressure reservoir 24. From the low pressure reservoir 24, the fluid can return directly to the inlet of pump 50 through the check valve 58.

The net flow of fluid from the high pressure reservoir 22 through the engine valve 12 into the low pressure reservoir 24 largely determines the loss of hydraulic energy in the system 8. The valvetrain consumes oil from the high pressure reservoir 22, and most of it is returned to the low pressure reservoir 24. A small additional loss is associated with leakage through the clearance between the valve 12 and its sleeve 13. A fluid return line 44, connected to a leak-off passage 52, provides a route for returning any fluid which leaks out to an oil sump 46.

The magnitude of the pressure at the inlet to the high pressure pump 50 is determined by a small low pressure pump 54 and its associated pressure regulator 56 which supply a small quantity of oil to the inlet of the high pressure pump 50 to compensate for the leakage through the leak-off passage 52.

In order to control the supply of the high pressure and low pressure fluid to volume 20 above the piston 16, the hydraulic rotary valve 34 is employed. It is actuated by an electric rotary motor 60, which controls the rotational motion and position of the rotary valve 34. The motor 60 is electrically connected to an engine control system 48, which activates it to determine the opening and closing timing. A motor shaft 64 rotationally couples the motor 60 to a cylindrical rotary valve body 66. The engine control system 48 can cause the motor 60 to rotate with angular velocity that is variable within each revolution.

The rotating valve and its operation are illustrated in FIGS. 2, 3A–3E, 4A–4E and 5. A stationary valve sleeve 62 is mounted within an opening in and rotationally fixed relative to the cylinder head 14. The valve body 66 is mounted within the sleeve 62 and can rotate relative to it. The inner diameter of the valve sleeve 62 is substantially the same as the outer diameter of the valve body 66, allowing for a small clearance so they can slip relative to one another.

The cylinder head 14 includes three ports and three annuli connecting to the opening in the cylinder head 14 in which the sleeve 62 is installed. A high pressure port 74 is connected between the high pressure line 26 and a high pressure annulus 75, which, in turn, abuts the valve sleeve 62. A low pressure port 76 is connected between the low pressure line 28 and a low pressure annulus 77, which, in turn, abuts the valve sleeve 62. A third annulus 79 abuts the valve sleeve 62 and connects to a third port 78 connected to the hydraulic line 32. The sleeve 62 includes two high pressure windows 86, located opposite one another and connected to the high pressure annulus 75. The sleeve 62 also includes two low pressure windows 90 located opposite one another and connected to the low pressure annulus 77. The windows 86 and 90 are in the same vertical plane.

The valve body 66 includes a pair of high pressure windows 82 and four low pressure windows 84. The high pressure windows 82 are located opposite one another on the valve body 66. They connect to the internal hollow 92 and are positioned such that each one lies adjacent to one of the high pressure windows 86 twice per revolution of the valve body 66 relative to the valve sleeve 62. The low pressure windows 84 are located in two pairs. The windows in each pair are positioned opposite one another and each window 84 is sixty degrees from one of the windows in the other pair. They are also positioned such that each window 84 lies adjacent to one of the low pressure windows 90 twice per revolution of the valve body 66 relative to the valve sleeve 62. The high pressure windows 82 are oriented relative to the low pressure windows 84 such that when the high pressure windows 82 are aligned with windows 86, the low pressure windows 84 are each sixty degrees away from its nearest window 90. Thus, every sixty degrees of rotation of the valve body 66, either one of the pairs of the low pressure windows 84 is aligned with the low pressure windows 90 or the pair of high pressure windows 82 is aligned with the high pressure windows 86.

Eight windows 80 are included in the valve sleeve 62, adjacent and connected to third annulus 79. This number and size of windows 80 can vary and are optimized to minimize the restrictions to the fluid flow. An annulus 88 about the inner surface of the valve sleeve 62 connects with the windows 80. Six central windows 94 in the valve body 66 connect between the annulus 88 and the internal hollow 92 in the valve body 66. This number and size of windows 94 can vary and are optimized to minimize the restrictions to the fluid flow. The internal hollow 92 creates a cavity allowing fluid to communicate between the windows 82, 84 and 94. In this way, internal hollow 92 is always hydraulically connected to the third port 78.

With this configuration, when the valve body 66 is positioned such that no windows 82 and 84 align with windows 86 and 90, respectively, which is the rotary valve's closed position, rotary valve 34 keeps third port 78 disconnected from the other two, 74 and 76. Rotating motor 60 until the pair of high pressure windows 82 align with windows 86 connects the third port 78 with the high pressure port 74. Rotation until one of the pairs of low pressure windows 84 aligns with windows 90 causes the third port 78 to connect with the low pressure port 76.

Figure 2:
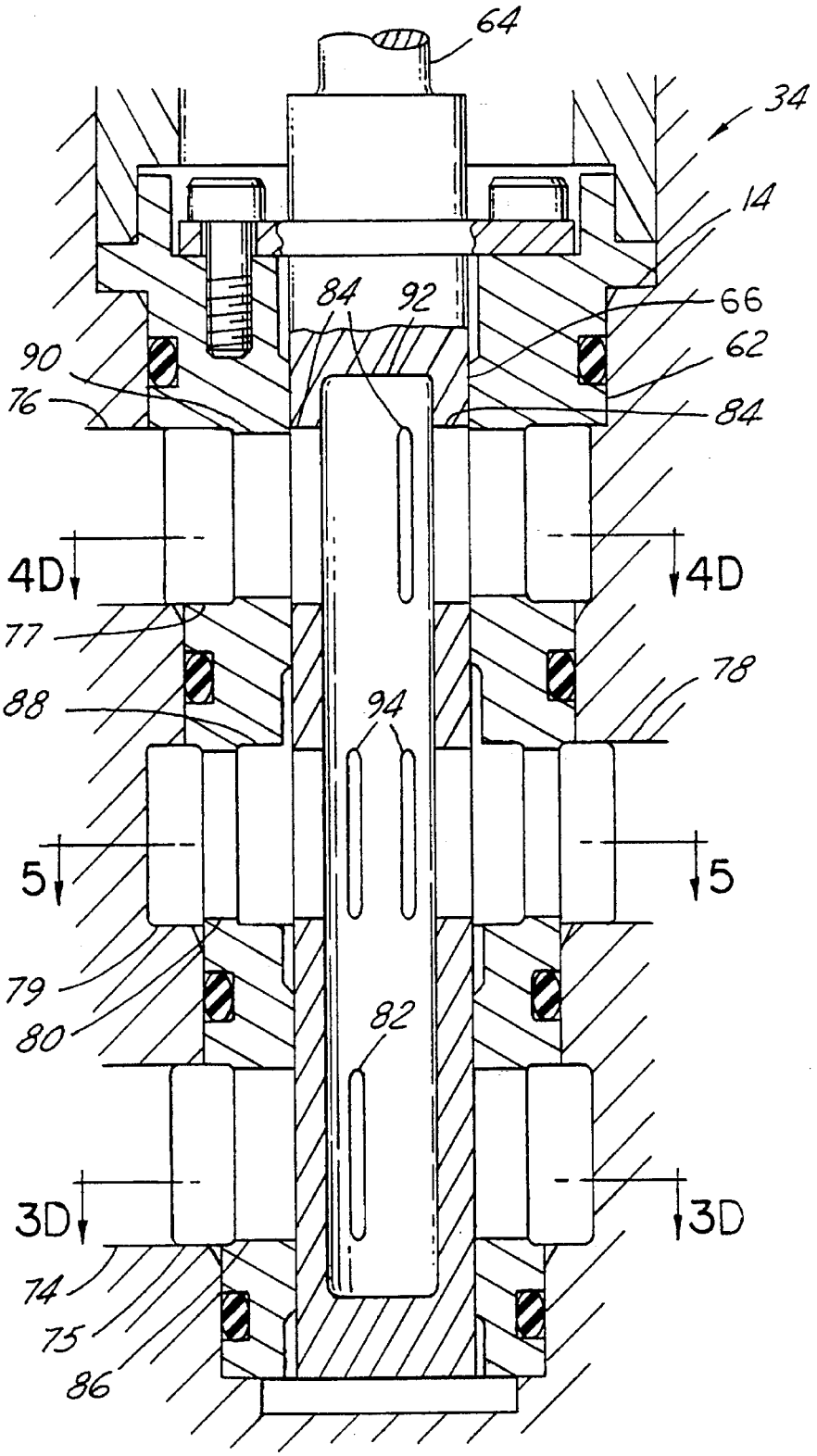
FIG. 2 is a sectional view, on an enlarged scale, of the rotary valve shown in FIG. 1.

The timing of the process of engine valve opening and closing for the system of FIGS. 1 and 2, taking place during one half of a rotary valve revolution, is illustrated in FIGS. 3A–3E and 4A–4E. In general, engine valve opening is controlled by the rotary valve 34 which, when positioned to allow high pressure fluid to flow from the high pressure line 26 into volume 20 via the hydraulic line 32, causes engine valve opening acceleration, and, when re-positioned such that no fluid can flow between line 26 and line 32, results in engine valve deceleration. Again re-positioning the rotary valve 34, allowing hydraulic fluid in volume 20 to flow into low pressure line 28 via hydraulic line 32, causes engine valve closing acceleration, and, when re-positioned such that no fluid can flow between line 28 and 32 results in deceleration.

Figure 3A:
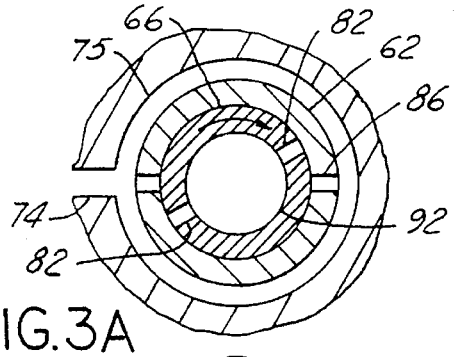
FIGS. 3A–3E are sectional views, on a reduced scale, taken along line 3D—3D in FIG. 2 illustrating various positions of the rotary valve during engine valve operation.
Figure 4A:
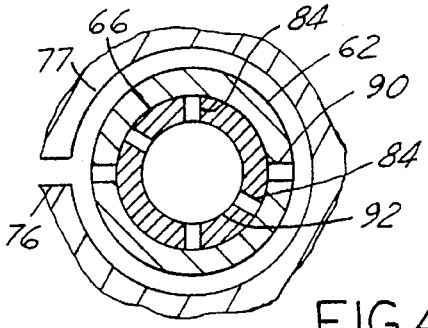
FIGS. 4A–4E are section views, on a reduced scale, taken along line 4D—4D in FIG. 2 illustrating various positions of the rotary vale during engine valve operation.
Figure 3B:
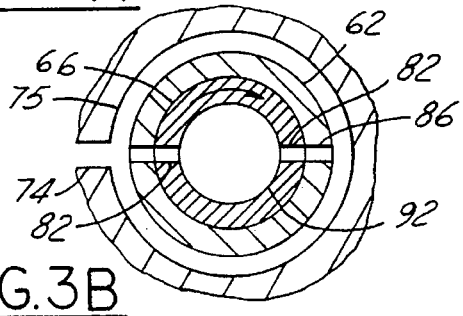
Figure 4B:
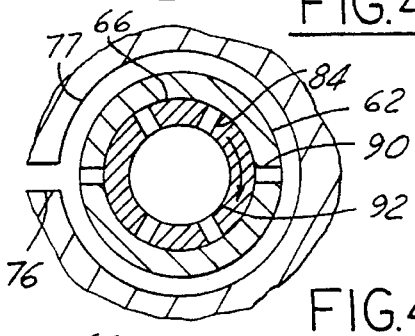

Thus, from a closed valve position, the process begins with the engine valve 12 closed and no high pressure windows 82, 86 and no low pressure windows 84, 90 aligned; FIGS. 3A and 4A. To initiate engine valve opening, the engine control system 48 activates the motor 60 to rotate the rotary valve body 66 so that the high pressure windows 82 align with the high pressure windows 86; FIGS. 3B and 4B. High pressure fluid flows from lines 26 through the valve 34 and into volume 20. The resultant net pressure force acting on the piston 16 accelerates the engine valve 12 downward.

Figure 3C:
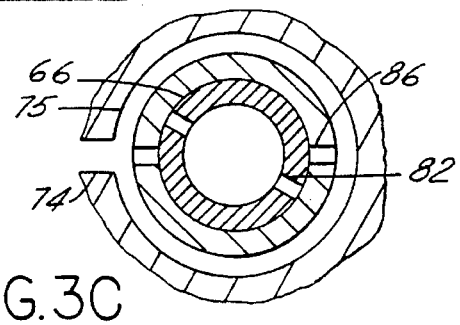
Figure 4C:
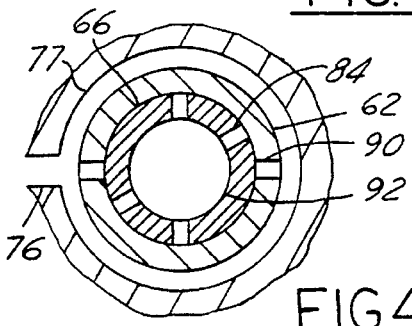

The engine control system 48 continues causing the motor 60 to rotate the rotary valve body 66 until the high pressure windows 82 no longer align with windows 86, a rotary valve closed position; FIGS. 3C and 4C. The engine valve 12 at this point possesses kinetic energy and continues to move downward. Because of this, the volume 20 above the piston 16 increases. Therefore, the pressure above the piston 16 drops, and the piston 16 decelerates pushing the fluid from volume 42 below it back through high pressure lines 26. The low pressure check valve 40 opens and fluid flowing through it prevents void formation in volume 20 above the piston 16. When the downward motion of the engine valve 12 stops, the low pressure check valve 40 closes and the engine valve 12 remains in its open position.

Figure 3D:
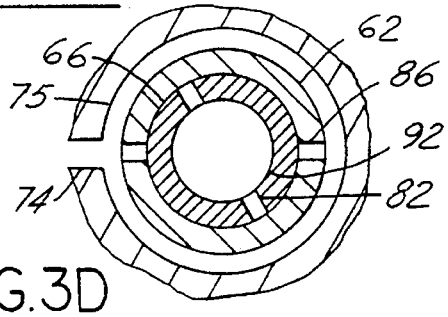
Figure 4D:
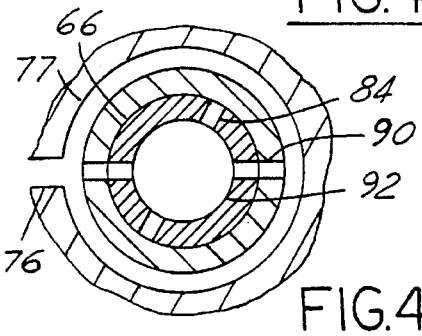

The process of valve closing is similar, in principle, to that of valve opening. The engine control system 48 activates the motor 60 to rotate the rotary valve body 66 so that the first pair of low pressure windows 84 align with low pressure windows 90; FIGS. 3D and 4D. Fluid flows from volume 20, through the valve 34 and into line 28. As a result, the pressure above the piston 16 drops and the net pressure force acting on the piston 16 accelerates the engine valve 12 upward.

The motor 60 further rotates the valve body 66 until the first pair of low pressure windows 84 no longer align with windows 90. Again the rotary valve 34 is in a closed position. The engine valve 12 at this point possesses kinetic energy and continues to move upward. Because of this, the volume 20 above the piston 16 decreases. Therefore, the pressure above the piston 16 rises, and the piston 16 decelerates. The high pressure check valve 36 opens as fluid from volume 20 is pushed through it back into the high pressure hydraulic lines 26 until the valve 12 stops just before it seats. In this way, the possibility of a hard impact during engine valve seating is avoided.

Figure 3E:
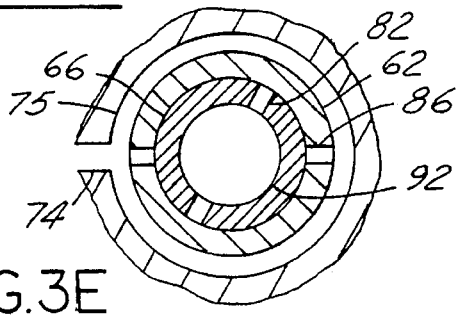
Figure 4E:
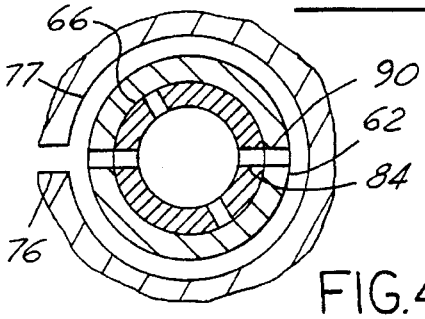

The valve body 66 is then rotated until the second pair of windows 84 align with the windows 90; FIGS. 3E and 4E. Fluid again flows from volume 20 and the engine valve 12 seats quietly in its closed position. The valve body 66 is rotated until the second pair of low pressure windows 84 no longer aligns with the low pressure windows 90. Thus, in 180 degrees rotation of the valve body 66, the engine valve 12 opens and closes. The second pair of low pressure windows 84 are not necessary for this system to operate, but are preferred to provide for the soft landing feature.

During the second half of the rotary valve revolution, the same sequence of events is repeated again. Therefore, the mean angular velocity of the valve body 66 is one quarter of the engine crankshaft speed. The times during which the windows 82 and 84 are in alignment with the windows 86 and 90, respectively, can be called the periods of window crossing. At low engine speed, the valve body 66 stops after each window crossing. At high engine speed, when the time interval between individual window crossings is very short, it is unnecessary to bring the valve body 66 to a complete stop after each crossing. Instead, the valve body 66 decelerates and then, without stopping, accelerates toward the next crossing.

Varying the timing of window crossings by the high and low pressure windows 82 and 84 varies the timing of the engine valve opening and closing. Valve lift can be controlled by varying the duration of the alignment of the high pressure windows 82 with windows 86. The duration of the alignment is a function of the angular velocity and angular acceleration of the valve body 66 during the alignment. It can be controlled by varying the magnitude and the direction of the driving torque from the motor 60. The duration of the window crossings of the windows 84 must also vary accordingly to assure a return stroke equal to the valve lift. Varying the fluid pressure in the high pressure reservoir 22 also permits control of engine valve acceleration, velocity and travel time.

Other numbers of window combinations can also be used, although it is desirable to locate the windows so that the hydraulic pressure forces acting on the rotary valve body 66 are balanced.

During each acceleration of the engine valve 12, potential energy of the pressurized fluid is converted into kinetic energy of the moving valve 12 and then, during deceleration, when the valve piston 16 pumps the fluid back into the high pressure reservoir 22, the kinetic energy is converted back into potential energy of the fluid, because the low pressure fluid enters through the low pressure check valve 40 and conserves the energy of the high pressure fluid that need not enter the high pressure chamber. Such recuperation of hydraulic energy contributes to reduced energy requirements for the system operation. As an alternate embodiment, a return spring can be used instead of the hydraulic pressure in the volume 42 below the piston 16 to generate the closing biasing force on the valve, although this is not the preferred means.

As a further alternate embodiment, this rotary valve could operate multiple hydraulically coupled valves as disclosed in U.S. Pat. No. 5,373,817 (assigned to the assignee of this invention), which is incorporated herein by reference.

While certain embodiments of the present invention have been described in detail, those familiar with the art to which this invention relates will recognize various alternative designs and embodiments for practicing the invention as defined by the following claims.

We claim:

1. A hydraulically operated valve control system for an internal combustion engine, the system comprising:

a high pressure hydraulic branch and a low pressure hydraulic branch, having a high pressure source of fluid and a low pressure source of fluid, respectively;

a cylinder head member adapted to be affixed to the engine and including an enclosed bore and chamber;

an engine valve shiftable between a first and a second position within the cylinder head bore and chamber;

a hydraulic actuator having a valve piston coupled to the engine valve and reciprocable within the enclosed chamber which thereby forms a first cavity which varies in volume as the engine valve moves;

a rotary valve assembly mounted to the cylinder head member including a sleeve and a cylindrical valve body mounted within the sleeve, with the valve body including two high pressure windows, four low pressure windows and at least one central window, and with the sleeve including two high pressure windows, two low pressure windows and at least one central window, with the windows in the sleeve operatively engaging their corresponding windows in the valve body;

the cylinder head member including three ports, a first port operatively engaging the high pressure branch and the sleeve high pressure windows, a second port operatively engaging the low pressure branch and the sleeve low pressure windows, and a third port operatively engaging the first cavity and the at least one sleeve central window, with the three ports being oriented such that the valve body can be rotated so that the high pressure windows in the valve body align with the high pressure windows in the sleeve, neither the high nor low pressure windows in the valve body align with one of the windows in the sleeve, and the low pressure windows in the valve body align with the low pressure windows in the sleeve, sequentially;

means for biasing the engine valve toward its closed position; and actuator means for rotating the rotary valve relative to the sleeve.

2. The hydraulically operated valve control system according to claim 1 wherein the means for biasing the engine valve toward its closed position comprises a second cavity formed within the enclosed chamber opposite the first cavity formed by the valve piston which also varies in volume as the engine valve moves and the cylinder head member further includes a high pressure line extending between the second cavity and the high pressure branch and the surface area of the valve piston exposed to the first cavity subjected to fluid pressure is larger than the surface area of the valve piston exposed to the second cavity subjected to fluid pressure.

3. The hydraulically operated valve control system according to claim 2 further including a high pressure check valve mounted between the first cavity and the high pressure source of fluid; and a low pressure check valve mounted between the first cavity and the low pressure source of fluid.

4. The hydraulically operated valve control system according to claim 3 wherein the actuator means comprises a rotary motor, a central shaft coupled between the motor and the valve body, and control means cooperating with the rotary motor for selectively changing the rotational speed of the motor.

5. The hydraulically operated valve control system according to claim 4 wherein the cylinder head member further includes a first annulus between the first port and the high pressure windows in the sleeve, a second annulus between the second port and the low pressure windows in the sleeve and a third annulus between the third port and the at least one central window in the sleeve, and the sleeve further includes an inner annulus operatively engaging the central window in the sleeve and the valve body.

6. The hydraulically operated valve control system according to claim 1 wherein the actuator means comprises a rotary motor, a central shaft coupled between the motor and the valve body, and control means cooperating with the rotary motor for selectively changing the rotational speed of the motor.

7. The hydraulically operated valve control system according to claim 1 further including a high pressure check valve mounted between the first cavity and the high pressure source of fluid.

8. The hydraulically operated valve control system according to claim 1 further including a low pressure check valve mounted between the first cavity and the low pressure source of fluid.

9. The hydraulically operated valve control system according to claim 1 wherein the cylinder head member further includes a first annulus between the first port and the high pressure windows in the sleeve, a second annulus between the second port and the low pressure windows in the sleeve and a third annulus between the third port and the central window in the sleeve, and the sleeve further includes an inner annulus operatively engaging the central window in the sleeve and the valve body.

10. A hydraulically operated valve control system for an internal combustion engine, the system comprising:

a high pressure hydraulic branch and a low pressure hydraulic branch, having a high pressure source of fluid and a low pressure source of fluid, respectively;

a cylinder head member adapted to be affixed to the engine and including an enclosed bore and chamber;

an engine valve shiftable between a first and a second position within the cylinder head bore and chamber;

a hydraulic actuator having a valve piston coupled to the engine valve and reciprocable within the enclosed chamber which thereby forms a first and a second cavity which vary in volume as the engine valve moves, with the surface area of the valve piston exposed to the first cavity subjected to fluid pressure that is larger than the surface area of the valve piston exposed to the second cavity;

a rotary valve assembly mounted to the cylinder head member including a sleeve and a cylindrical valve body mounted within the sleeve, with the valve body including two high pressure windows, four low pressure windows and at least two central windows, and with the sleeve including two high pressure windows, two low pressure windows and at least two central windows, with the windows in the sleeve operatively engaging their corresponding windows in the valve body;

the cylinder head member including three ports, a first port operatively engaging the high pressure branch and the sleeve high pressure windows, a second port operatively engaging the low pressure branch and the sleeve low pressure windows, and a third port operatively engaging the first cavity and the sleeve central windows, with the three ports being oriented such that the valve body can be rotated so that the high pressure windows in the valve body align with the high pressure windows in the sleeve, neither the high nor low pressure windows in the valve body align with one of the windows in the sleeve, and the low pressure windows in the valve body align with the low pressure windows in the sleeve, sequentially;

the cylinder head member further including a high pressure line extending between the second cavity and the high pressure branch;

a high pressure check valve mounted between the first cavity and the high pressure source of fluid;

a low pressure check valve mounted between the first cavity and the low pressure source of fluid;

means for biasing the engine valve toward its closed position; and actuator means for rotating the rotary valve relative to the sleeve.

11. The hydraulically operated valve control system according to claim 10 wherein the cylinder head member further includes a first annulus between the first port and the high pressure windows in the sleeve, a second annulus between the second port and the low pressure windows in the sleeve and a third annulus between the third port and the central windows in the sleeve, and the sleeve further includes an inner annulus operatively engaging the central windows in the sleeve and the valve body.

* * * * *